US005850205A

United States Patent [19]

Blouin

[11] Patent Number: 5,850,205

[45] Date of Patent: Dec. 15, 1998

[54] AUTOMATIC CONTRAST CONTROL FOR LIQUID CRYSTAL DISPLAYS

[75] Inventor: Francois Blouin, Hull, Canada

[73] Assignee: Northern Telecom Limited, Montreal, Canada

[21] Appl. No.: 813,440

[22] Filed: Mar. 10, 1997

[51] Int. Cl.[6] ..... G09G 3/36

[52] U.S. Cl. ..... 345/102; 345/89

[58] Field of Search ..... 345/101, 102, 345/904, 85, 89, 114, 117, 207, 214

[56] References Cited

U.S. PATENT DOCUMENTS

| | | | |
|---|---|---|---|
| 4,888,599 | 12/1989 | Harwood | 340/812 |
| 5,029,982 | 7/1991 | Nash | 350/331 |
| 5,153,756 | 10/1992 | Ike | 359/85 |
| 5,162,785 | 11/1992 | Fagard | 340/784 |
| 5,406,305 | 4/1995 | Shimomura et al. | 345/102 |
| 5,489,918 | 2/1996 | Mosier | 345/89 |
| 5,517,212 | 5/1996 | Inoue | 345/211 |
| 5,608,422 | 3/1997 | Ikeda | 345/101 |

*Primary Examiner*—Xiao Wu
*Assistant Examiner*—Ronald Laneau

[57] ABSTRACT

An LCD with automatic contrast control is provided. A light sensor is mounted over a test pixel which is separate form the main viewing area of the LCD for taking luminance measurements for "ON", "OFF", and "surround" pixel states for a series of candidate operating voltages. The pixel contrast ratio and background contrast ratio are computed for each candidate voltage and the voltage resulting in the best contrast is selected as the operating voltage for the entire LCD.

28 Claims, 3 Drawing Sheets

AUTOMATIC CONTRAST CONTROL FOR LIQUID CRYSTAL DISPLAYS

FIELD OF THE INVENTION

The invention relates to the automatic control of contrast in liquid crystal displays.

BACKGROUND OF THE INVENTION

The readability of an LCD (liquid crystal display) is a function of the level of contrast between the luminance of pixels in the display which are "ON", the luminance of the pixels in the display which are "OFF", and the luminance of the surrounding pixels which are inactive (neither ON nor OFF).

The brightness of both "ON" and "OFF" pixels is determined by an operating voltage. For each LCD display, there is an optimal operating voltage for which the contrast, and hence display readability, is optimized.

It is common for LCD screens to have preset operating voltages which are not equal to their optimal operating voltages resulting in reduced display legibility. This may be caused by non-consistent optimal operating voltages from batch to batch, or from manufacturer to manufacturer for example. It is too expensive to perform a test during manufacture to determine the optimal operating voltage.

Liquid crystal fluids are sensitive to temperature so that a variation in temperature also changes the optimal operating voltage. This causes a display which has the optimal contrast at one temperature to have a suboptimal contrast at another temperature.

In screens which allow a user to adjust the contrast setting, most users do not know how to set the optimal contrast level, again resulting in the use of a suboptimal contrast level.

SUMMARY OF THE INVENTION

It is an object of the invention to provide an improved LCD display.

According to a broad aspect, the invention provides an LCD (liquid crystal display) comprising: a main display area having a first adjustable operating voltage; at least one test pixel having a second adjustable operating voltage; for each test pixel, a light sensor located to make luminance measurements on the test pixel, and a reference light source located to transmit light through the test pixel to the light sensor; and processing means for setting the first operating voltage on the basis of luminance measurements collected from the light sensor(s) for a range of values of the second operating voltage.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1A:
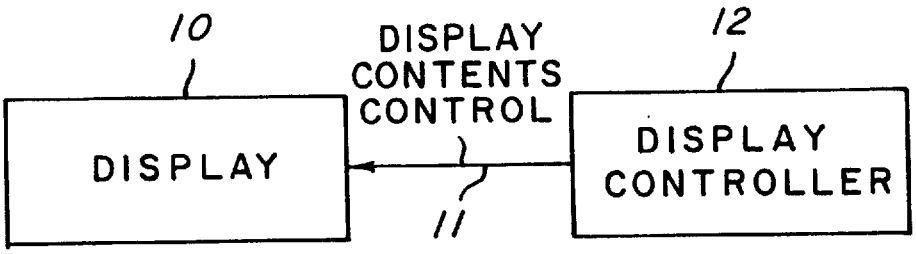
FIG. 1a (PRIOR ART)
FIG. 1*a* is a block diagram of a conventional LCD.
Figure 1B:
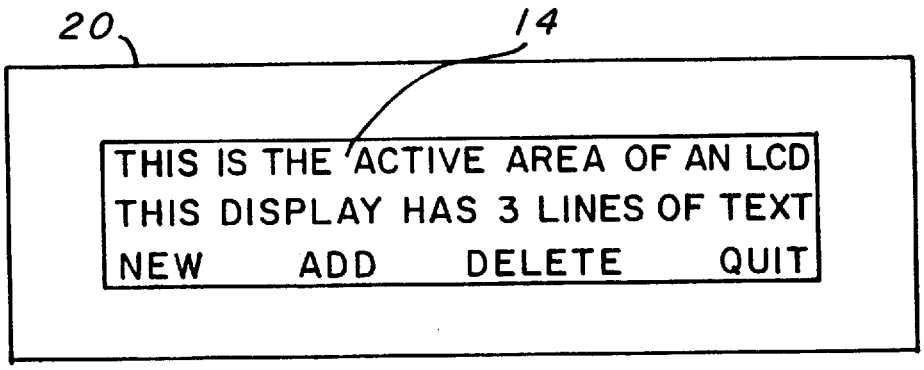
FIG. 1b (PRIOR ART)
FIG. 1*b* is a plan view of a conventional LCD.

Referring to FIG. 1*a* which is a block diagram of a conventional LCD, there is a display screen 10 which is controlled by display contents control signals 11 generated by a display controller 12. Referring to FIG. 1*b*, the display screen has a main viewing area 14 which is visible to users, which is displaying three lines of text in the illustrated example.

Figure 1C:
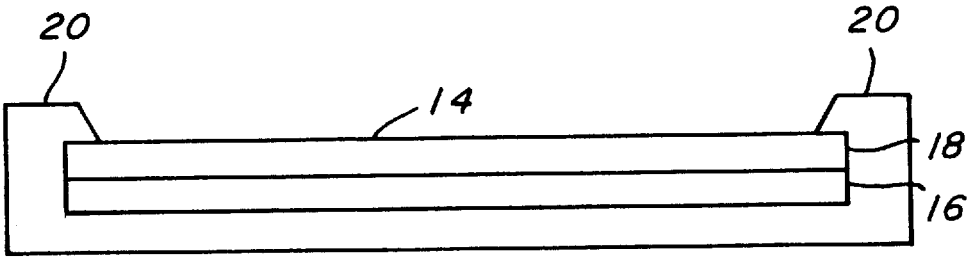
FIG. 1c (PRIOR ART)
FIG. 1*c* is a side sectional view of the LCD of FIG. 1*b*.

In FIG. 1*c*, a side elevation is shown. The LCD has a backlight 16, a display glass 18, and is surrounded by a display case 20 which typically overlaps the display glass 18 slightly as shown to define the main viewing area 14.

Figure 2:
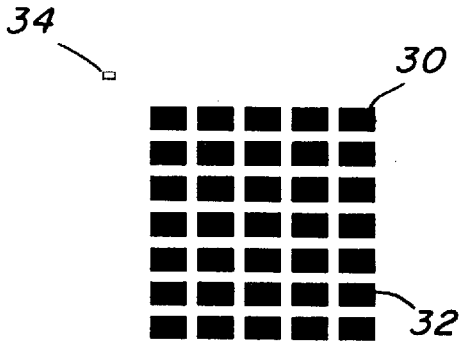
FIG. 2 (PRIOR ART)
FIG. 2 is an illustration of a pixel matrix.

An enlarged view of an LCD pixel matrix showing the letter "E" is shown diagrammatically in FIG. 2. Pixels contributing to the letter "E" include ON pixels 30, and OFF pixels 32. The area surrounding the pixel matrix which is neither ON nor OFF, is referred to as "surround" area, a sample of which is indicated by reference numeral 34. To turn a pixel ON, a predetermined ON voltage is applied; to turn a pixel OFF, a predetermined OFF voltage is applied; finally a pixel or portion of the display which is "surround" has no voltage applied, i.e. a voltage of zero.

The luminance of the "surround" area 34 is determined by the luminance of the backlight 16. The luminance of an ON pixel 30 is determined by the amount of light produced by the backlight 16 which can penetrate a pixel forming part of display glass 18 which is in the ON state. Finally, the luminance of an OFF pixel 32 is determined by the amount of light produced by the backlight 16 which can penetrate a pixel forming part of the display glass 18 which is in the OFF state. Thus it is the backlight 16 which provides a reference luminance level which happens to be maximum luminance level possible.

The PCR (pixel contrast ratio) is defined by the ratio of the luminance of the "OFF" pixels to the luminance of the "ON" pixels.

$$PCR = \frac{\text{OFF luminance}}{\text{ON luminance}}$$

The PCR is a prime determinant of display readability. The higher the PCR, the more readable is the display. It is common to use PCR=3 as the minimum value recommended for adequate legibility.

The BCR (background contrast ratio) is defined by the ratio of the luminance of the "OFF" pixels to the luminance of the surround area of the display surrounding the active pixels, the surround area being the non active area.

$$BCR = \frac{\text{surround luminance}}{\text{OFF luminance}}$$

The BCR determines the visibility of pixels in the "OFF" condition. Most displays are time multiplexed, and a residual voltage is always present at any "OFF" pixel which causes partial activation of the pixel. This residual voltage is an increasing function of the operating voltage VOP in the range of voltages of interest. Ideally, the BCR should be 1 which would make the "OFF" pixels and the surround area equally luminous. However, with existing LCD technologies, this ideal target is unrealizable. An acceptable target is 1.1 or less over the entire viewing area, rendering the "OFF" pixels virtually undetectable.

The LCD contrast ratios PCR and BCR are each a function of an RMS operating voltage VOP applied to the LCD cell. In conventional LCD's VOP is either fixed during manufacture or adjustable under user control.

Figure 3:
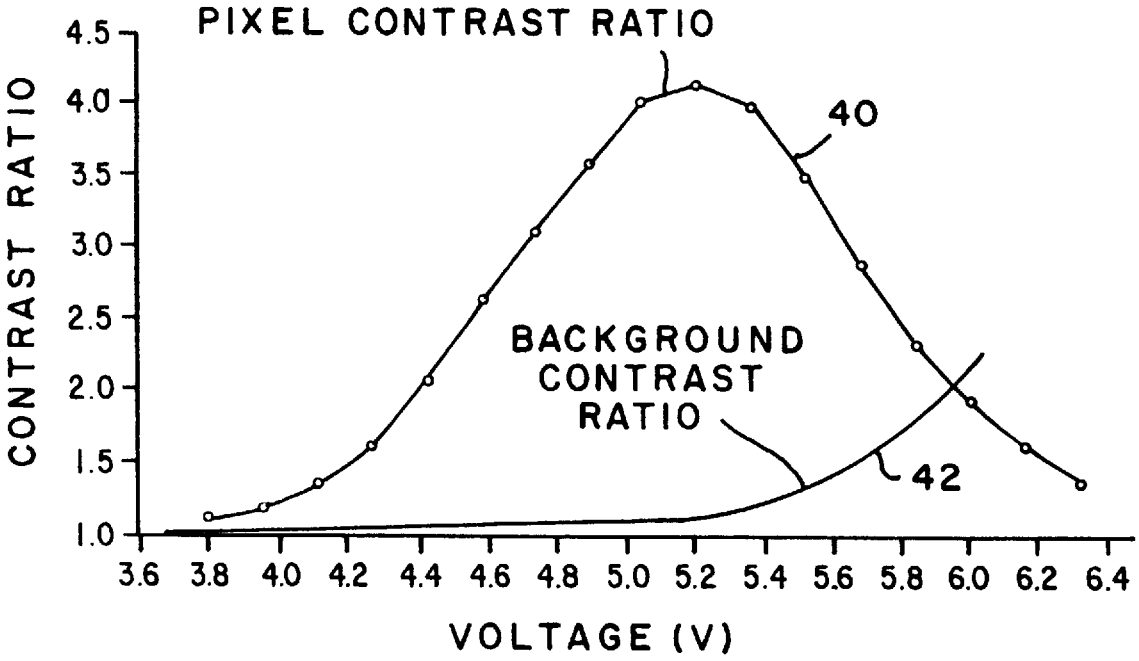
FIG. 3 (PRIOR ART)
FIG. 3 is a plot of contrast ratios as a function of operating voltage for a typical LCD.

FIG. 3 is a plot of the PCR and BCR as a function of VOP for a typical LCD. The PCR is plotted in curve 40 and the BCR is plotted in curve 42. The PCR increases as a function of VOP until saturation occurs, at which point the PCR decreases with further increases in VOP. In the illustrated example, saturation occurs at about 5.2 V. At the same time, the BCR also increases as a function of VOP.

Figure 4A:
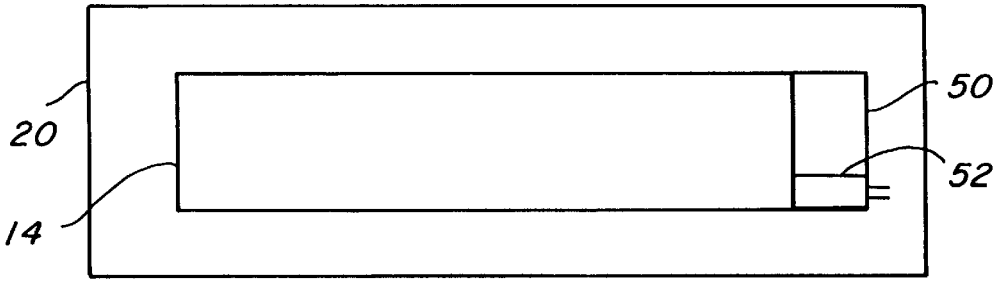
FIG. 4*a* is a plan view of an LCD according to the invention.

Referring now to FIG. 4*a*, a plan view of an LCD according to the invention is shown. The display has a main viewing area 14, and has an additional test display area 50 which is typically not viewable by a user. A side elevation is shown in FIG. 4*c* which shows the display housing 20 covering the test display area 50 and defining the main viewing area 14. A light sensor 52 is shown mounted over a test pixel (not shown) in the test display area 50. The light sensor 52 is used to measure the ON luminance, OFF luminance, and surround luminance by making measurements on the test pixel. The light sensor may be any sensor suitable for mounting over a pixel, for example a CCD (charge coupled device), photodetector, or photodiode.

Figure 4B:
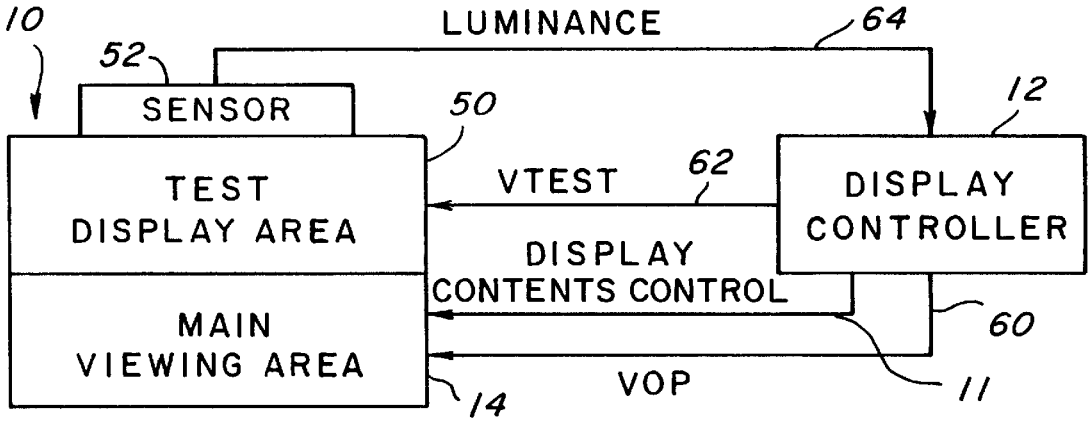
FIG. 4*b* is a block diagram of an LCD according to the invention.
Figure 4C:
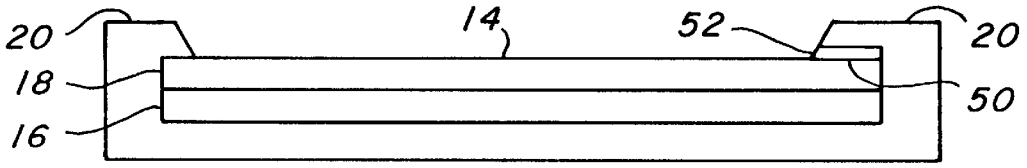
FIG. 4*c* is a side sectional view of the LCD of FIG. 4*b*.

Referring now to the block diagram in FIG. 4*b*, a display controller 12 controls the contents of the display screen 10 as in the case of a conventional display with display contents control signals 11. In addition, the display controller 12 sets the operating voltage VOP 60 for the main viewing area 14 of the display screen 10. The test display area 50 has a separate operating voltage VTEST 62 which is also under control of the display controller 12. The light sensor 52 passes to the display controller 12 luminance measurements 64 made on the test pixel.

According to the invention, the display controller 12 periodically runs a COP (contrast optimization process). The COP applies to the test pixel a series of test voltages, VTEST, which are voltages in a range of voltages near a typical operating point VOP. The light sensor produces a luminance measurement and passes this to the COP. For each test voltage VTEST, the COP instructs the test pixel to be in each of the three possible pixel states, namely ON, OFF, and disable (OV) which is equivalent to surround, and measures the luminance of each pixel state for each of these values of VTEST. The display controller 12 then computes the BCR and PCR for each of these VTEST values, and adjusts the VOP used for the main display area 14 if necessary, as discussed below.

To determine what the optimal operating voltage VOP is, the controller 12 first determines if any of the BCR readings are above a predetermined maximum, for example 1.1. If there are, then voltages which resulted in these readings are not considered. Since the BCR is an increasing function of operating voltage, the first voltage causing a BCR which is too large may be considered an upper bound. For example, referring to FIG. 3 a series of VTEST voltages in the range 3.8V to 6.4V has been applied. For voltages above about 5.3V the BCR is above 1.1 so 5.3V is an upper bound on the acceptable operating voltage. From the voltages below the upper bound, the voltage having the largest PCR is selected. In FIG. 2, the voltage below 5.3 having the largest PCR is 5.2V. The controller 12 then instructs this voltage to be used as VOP for the main viewing area 14.

It is noted that in the illustrated example, the optimum VOP happens to correspond with the voltage resulting in the maximum PCR, namely 5.2 V, since this voltage is below the BCR threshold voltage of 5.3 V. However, in general, the BCR and PCR are functions which change with temperature and from batch to batch. It may be that in certain LCDs, the PCR maximum occurs for a voltage which has an unacceptably large BCR. In such cases, an operating voltage will be selected which results in an acceptable BCR but which results in a PCR which is less than the maximum possible.

A particular sequence of steps for determining an operating voltage have been described, but it is to be understood that other methods may be employed. For example an operating voltage might be selected which maximizes the difference between the PCR and the BCR.

The contrast optimization process may be repeated at regular intervals, every 5 or 10 minutes for example. Alternatively, a "set optimal contrast" button may be provided which allows a user to instigate the process.

Figure 5:
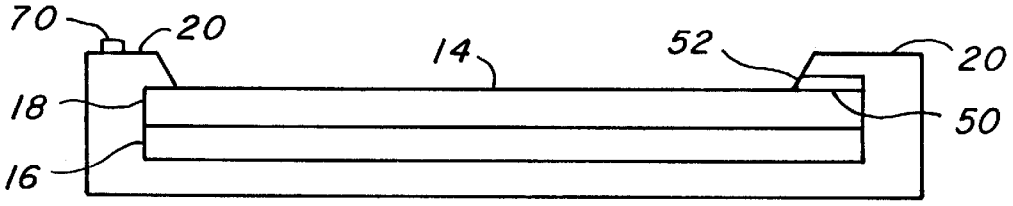
FIG. 5 is a side sectional view of another LCD according to the invention.

According to another aspect of the invention, the above described embodiment is further provided with an ambient light detector. This is depicted in FIG. 5 which is a side sectional view of an LCD according to the invention. This is the same as FIG. 4 with the exception of an ambient light sensor 70 so located to be able to detect the level of the light around the LCD display. In the illustrated embodiment, the ambient light sensor is shown mounted on the LCD housing. However, it could be mounted anywhere so long as it is exposed to the ambient light effecting the contrast of the LCD. The ambient light detector 70 is connected to the display controller so as to be able to pass ambient light measurements to the display controller. Depending on the level of ambient light, a different criterion is used to set the optimal contrast. For example, the ambient light readings may be divided into three ranges, these being low light, normal light, and high light. Depending on the range detected, a different criterion is used by the display controller. An example of this is summarized in the following table:

| Operating Condition | Example | Optimum PCB/BCR setting | Rationale |
|---|---|---|---|
| low lighting | living room | PCR = 3 and min BCR | By reducing the off pixel visibly (BCR), this increases the overall display brightness which increases legibility in low light conditions |
| normal lighting | office lighting | max PCR and BCR <1.1 | Compromise between PCR and BCR |
| high lighting | outside sunny day, bright sunlight | max PCR and BCR = 1.1 | Increas PCR as much as possible and set BCR to the maximum (1.1). BCR at 1.1 would not degrade legibility since the display is illuminated by a very bright light source, in addition PCR would be maximized. |

Numerous modifications and variations of the present invention are possible in light of the above teachings. It is therefore to be understood that within the scope of the appended claims, the invention may be practised otherwise than as specifically described herein.

To satisfy those users who want to be able to set the contrast, a "set contrast" function may also be provided which allows the user to set the contrast. Of course, this likely will result in a suboptimal contrast setting being used.

Rather than controlling a single pixel to be in each of three states, three pixels and three light sensors could be used, with one pixel/sensor being used to continuously measure the luminance of each state.

In order to obtain precise luminance measurements, a stable reference light source is preferred. In the above described embodiment, a backlight has been used because it has a stable output luminance and allows the test pixel to be in a non-visible area behind the display housing. In displays without a backlight some other reference light source must be provided beneath the test pixel and sensor.

The invention may be applied to both passive matrix and active matrix displays, and may be applied to both monochrome and colour displays. It is noted that colour displays have a slightly different construction. An additional colour filter layer is added in between the backlight and the display glass. In colour displays, each pixel is subdivided into three subpixels, one each for red, green and blue. Each subpixel is covered by a respective colour filter.

In order to achieve the best performance the test pixel should only have one colour filter. The green filter is recommended for its superior light transmission characteristics.

The embodiments of the invention in which an exclusive property or privilege is claimed are defined as follows:

1. An LCD (liquid crystal display ) comprising:

a main display area having a first adjustable operating voltage;

at least one test pixel having a second adjustable operating voltage;

for each test pixel, a light sensor located to make luminance measurements on the test pixel, and a reference light source located to transmit light through the test pixel to the light sensor; and processing means for controlling the second operating voltage to be a plurality of different values over a range, for collecting luminance measurements from said light sensor(s) for ON, OFF, and disable pixel states for each of said different values in said range, and for setting the first operating voltage on the basis of luminance measurements.

2. An LCD according to claim 1 comprising one test pixel and sensor, wherein the luminance measurements comprise measurements for each of the three states of the one test pixel.

3. An LCD according to claim 1 comprising three test pixels and three respective sensors, one pixel being permanently in a disable state, one being in an ON state and one being in an OFF state, wherein the luminance measurements comprise an ON luminance measurement for the pixel permanently in the ON state, an OFF luminance measurement for the pixel permanently in the OFF state and a disable luminance measurement for the pixel permanently in the disable state.

4. An LCD according to claim 1 wherein the first operating voltage is set on the basis of a pixel contrast ratio and a background contrast ratio determined for the test pixel luminance measurements, the pixel contrast ratio being the ratio of the ON luminance measurement to the OFF luminance measurement, and the background contrast ratio being the ratio of the OFF luminance to the disable luminance.

5. An LCD according to claim 1 wherein the display has a housing and a backlight, the backlight fulfilling the role of the reference light source and wherein the at least one test pixel and light sensor are covered from view by a portion of housing.

6. An LCD according to claim 1 wherein the first operating voltage is set on a periodic basis.

7. An LCD according to claim 1 further comprising a user input mechanism which allows a user to instigate the setting of the first operating voltage by the processing means.

8. An LCD according to claim 3 wherein the first operating voltage is set on the basis of a pixel contrast ratio and a background contrast ratio determined for the test pixel luminance measurements, the pixel contrast ratio being the ratio of the ON luminance measurement to the OFF luminance measurement, and the background contrast ratio being the ratio of the OFF luminance to the disable luminance.

9. An LCD according to claim 2 wherein the display has a housing and a backlight, the backlight fulfilling the role of the reference light source and wherein the test pixel and light sensor are covered from view by a portion of housing.

10. An LCD according to claim 3 wherein the display has a housing and a backlight, the backlight fulfilling the role of the reference light source and wherein the test pixels and light sensors are covered from view by a portion of housing.

11. An LCD according to claim 2 wherein the first operating voltage is set on a periodic basis.

12. An LCD according to claim 2 further comprising a user input mechanism which allows a user to instigate the setting of the first operating voltage by the processing means.

13. An LCD according to claim 1 further comprising an ambient light sensor connected to pass an ambient light measurement to the processing means, wherein the processing means sets the first operating voltage according to a criterion which is dependent upon the ambient light measurement.

14. An LCD (liquid crystal display) comprising:

a main display area having a adjustable operating voltage;

a test pixel having a second adjustable operating voltage;

a light sensor located to make luminance measurements on the test pixel, and a reference light source located to transmit light through the test pixel to the light sensor; and processing means for setting the second operating voltage to a sequence of values and collecting luminance measurements from the light sensor for each of these values, wherein the luminance measurements comprise measurements for each of three states of the test pixel, these being ON, OFF, and disable, for determining a pixel contrast ration and a background contrast ration for each of these values and for which value the contrast performance is best, the pixel contrast ration being the ratio of the ON luminance measurement to the OFF luminance measurement, and the background contrast ration being the ratio of the OFF luminance to the disable, and for setting the first operating voltage to the value having the best contrast performance.

15. An LCD according to claim 14 wherein the BCRs are examined by the processing means, and the maximum voltage for which the BCR is below a preset value is selected as an upper bound on the selection of the first operating voltage, and the voltage equal to or below the upper bound for which the PCR is largest is selected as the value having the best contrast performance.

16. An LCD according to claim 15 wherein the first operating voltage is set on a periodic basis.

17. An LCD according to claim 15 further comprising a user input mechanism which allows a user to instigate the setting of the first operating voltage by the processing means.

18. An LCD according to claim 14 further comprising an ambient light sensor connected to pass an ambient light measurement to the processing means, wherein the processing means sets the first operating voltage according to a criterion which is dependent upon the ambient light measurement.

19. An LCD according to claim 18 wherein the processing means determines the ambient light measurement to be either low, normal, or high, and wherein for a low ambient light measurement, the first operating voltage is selected to result in a PCR equal to a predetermined PCR and a minimum BCR, and for a normal ambient light measurement the first operating voltage is selected to result in a maximum PCR and a BCR less than a predetermined threshold, and for a high ambient light measurement, the first operating voltage is selected to result in the maximum PCR and a BCR equal to a predetermined BCR.

20. An LCD (liquid crystal display) comprising:

a main display area having a first adjustable operating voltage;

three test pixels having a second adjustable operating voltage, one pixel being permanently in a disable state, one being in an ON state and one being in an OFF state;

three light sensors, one for each test pixel located to make luminance measurements on the respective test pixel, a reference light source located to transmit light through the test pixels to the light sensors;

processing means for setting the second operating voltage to a sequence of values and collecting luminance measurements from the light sensors for each of these values, wherein the luminance measurements comprise an ON luminance measurement for the pixel permanently ON, an OFF luminance measurement for the pixel permanently OFF and a disable luminance measurement for the pixel permanently disabled, for determining a pixel contrast ratio and a background contrast ratio for each of these values and for which value the contrast performance is best, the pixel contrast ration being the ratio of the ON luminance measurement to the OFF luminance measurement, and the background contrast ration being the ratio of the OFF luminance to the disable, and for setting the first operating voltage to the value having the best contrast performance.

21. An LCD according to claim 20 wherein the BCRs are examined by the processing means, and the maximum voltage for which the BCR is below a preset value is selected as an upper bound on the selection of the first operating voltage, and the voltage equal to or below the upper bound for which the PCR is largest is selected as the value having the best contrast performance.

22. An LCD according to claim 21 wherein the display has a housing and a backlight, the backlight fulfilling the role of the reference light source and wherein the test pixels and light sensors are covered from view by a portion of housing.

23. An LCD according to claim 21 wherein the first operating voltage is set on a periodic basis.

24. An LCD according to claim 21 further comprising a user input mechanism which allows a user to instigate the setting of the first operating voltage by the processing means.

25. An LCD (liquid crystal display) comprising:

a main display area and at least one test pixel having an adjustable operating voltage;

for each test pixel, a light sensor located to make luminance measurements on the test pixel, and a reference light source located to transmit light through the test pixel to the light sensor; and processing means for controlling the operating voltage to be a plurality of different values over a range, for collecting luminance measurements from said light sensor(s) for ON, OFF, and disable pixel states for each of said different values in said range, and for setting the operating voltage on the basis of luminance measurements.

26. An LCD according to claim 25 comprising one test pixel and sensor, wherein the luminance measurements comprise measurements for each of the three states of the one test pixel.

27. An LCD according to claim 25 comprising three test pixels and three respective sensors, one pixel being permanently in a disable state, one being in an ON state and one being in an OFF state, wherein the luminance measurements comprise an ON luminance measurement for the pixel permanently in the ON state, an OFF luminance measurement for the pixel permanently in the OFF state and a disable luminance measurement for the pixel permanently in the disable state.

28. An LCD according to claim 25 wherein the first operating voltage is set on the basis of a pixel contrast ratio and a background contrast ratio determined for the test pixel luminance measurements, the pixel contrast ratio being the ratio of the ON luminance measurement to the OFF luminance measurement, and the background contrast ratio being the ratio of the OFF luminance to the disable luminance.

* * * * *

UNITED STATES PATENT AND TRADEMARK OFFICE

CERTIFICATE OF CORRECTION

PATENT NO. : 5850205

DATED : December 15, 1998

INVENTOR(S) : FRANCOIS BLOUIN

It is certified that error appears in the above-identified patent and that said Letters Patent is hereby corrected as shown below: Column 6, lines 53 to 58

"... pixel contrast <u>ratio</u> and a background contrast <u>ratio</u> for each of these values and for which value the contrast performance is best, the pixel contrast <u>ratio</u> being the ratio of the ON luminance measurement to the OFF luminance measurement, and the background contrast <u>ratio</u> being the ratio of the ..."

Col. line 45: "...contrast performance is best, the pixel contrast <u>ratio</u> ..."

Signed and Sealed this

Thirtieth Day of March, 1999

*Attest:*

*Attesting Officer*

Q. TODD DICKINSON

*Acting Commissioner of Patents and Trademarks*